US009464831B2

(12) United States Patent
Lemee et al.

(10) Patent No.: US 9,464,831 B2
(45) Date of Patent: Oct. 11, 2016

(54) COMBINED DEVICE HAVING AN INTERNAL HEAT EXCHANGER AND AN ACCUMULATOR, AND EQUIPPED WITH AN INTERNAL MULTI-FUNCTION COMPONENT

(75) Inventors: Jimmy Lemee, Saint Jean d'Asse (FR); Christophe Denoual, Noyen sur Sarthe (FR); Alain Pourmarin, La Suze sur Sarthe (FR); Eric Goyet, Arnage (FR); Michel Meiche, Ruaudin (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 1057 days.

(21) Appl. No.: 12/644,329

(22) Filed: Dec. 22, 2009

(65) Prior Publication Data

US 2010/0155017 A1 Jun. 24, 2010

(30) Foreign Application Priority Data

Dec. 22, 2008 (FR) ..... 08 07423

(51) Int. Cl.
*F25B 43/00* (2006.01)
*F25B 15/00* (2006.01)
(Continued)

(52) U.S. Cl.
CPC ..... *F25B 43/006* (2013.01); *F25B 15/00* (2013.01); *F25B 37/00* (2013.01); *F25B 40/00* (2013.01); *F25B 41/00* (2013.01); *F25B 43/00* (2013.01); *F25B 43/02* (2013.01); *F28D 7/04* (2013.01);
(Continued)

(58) Field of Classification Search
CPC ..... F25B 43/00; F25B 43/006; F25B 15/00; F25B 37/00; F25B 41/00; F25B 40/00; F25B 43/02; F25B 2400/02; F25B 2400/051
USPC ..... 62/503, 486, 513, 472
See application file for complete search history.

(56) References Cited

U.S. PATENT DOCUMENTS 3,060,704 A * 10/1962 Miller ..... 62/503
3,955,375 A * 5/1976 Schumacher ..... 62/217
(Continued)

FOREIGN PATENT DOCUMENTS

EP 1808654 A2 7/2007
FR 2913764 A1 9/2008
(Continued)

OTHER PUBLICATIONS

Merriam-Webster definiation of "delimiting".*
(Continued)

*Primary Examiner* — Marc Norman
*Assistant Examiner* — David Teitelbaum
(74) *Attorney, Agent, or Firm* — Howard & Howard Attorneys PLLC

(57) ABSTRACT

The invention relates to a combined device (12) comprising a casing (26) made of an upper wall (27), a down wall (28) and a lateral wall (29). The said casing (26) accommodates an internal heat exchanger (5), a separation area (19) and an accumulation area (20). The casing (26) accommodates an internal component (30) which is made of:

- a partition wall (31) of the separation area (19) and the accumulation area (20),
- a confining wall (32) of the internal heat exchanger (5) versus the accumulation area (20), and
- a pipe (33) which is between the confining wall (32) and the partition wall (31).

17 Claims, 9 Drawing Sheets

(51) Int. Cl.

| | |
|---|---|
| ***F25B 37/00*** | (2006.01) |
| ***F25B 41/00*** | (2006.01) |
| ***F25B 43/02*** | (2006.01) |
| ***F25B 40/00*** | (2006.01) |
| ***F28D 7/04*** | (2006.01) |

(52) U.S. Cl.
CPC ..... *F25B 2400/02* (2013.01); *F25B 2400/051* (2013.01)

(56) References Cited

U.S. PATENT DOCUMENTS

| | | | | |
|---|---|---|---|---|
| 4,217,765 | A * | 8/1980 | Ecker | 62/503 |
| 4,938,036 | A * | 7/1990 | Hodgkins et al. | 62/323.1 |
| 4,942,743 | A * | 7/1990 | Gregory | 62/503 |
| 5,479,790 | A * | 1/1996 | Bottum et al. | 62/503 |
| 6,032,482 | A * | 3/2000 | Krauss | 62/513 |
| 6,463,757 | B1 | 10/2002 | Dickson et al. | |
| 6,523,365 | B2 * | 2/2003 | Zhang et al. | 62/503 |
| 6,584,784 | B2 * | 7/2003 | Gaul | 62/113 |
| 6,584,796 | B2 * | 7/2003 | Itoh et al. | 62/324.1 |
| 7,152,427 | B2 * | 12/2006 | Haussmann | 62/503 |
| 7,284,394 | B2 * | 10/2007 | Heyl et al. | 62/503 |
| 2003/0121648 | A1 * | 7/2003 | Hong et al. | 165/163 |
| 2005/0103046 | A1 * | 5/2005 | Heyl et al. | 62/503 |
| 2006/0010905 | A1 | 1/2006 | Gu | |
| 2006/0196223 | A1 * | 9/2006 | Dexter et al. | 62/503 |
| 2006/0254310 | A1 * | 11/2006 | Kamsma | 62/509 |

FOREIGN PATENT DOCUMENTS

| | | | |
|---|---|---|---|
| JP | 10-019421 | A | 1/1998 |
| JP | 2004-028525 | A | 1/2004 |
| JP | 2005-299949 | A | 10/2005 |

OTHER PUBLICATIONS

English language abstract for FR 2913764 extracted from espacenet.com database, dated Mar. 16, 2010, 38 page.
English language translation and abstract for JP 10-019421 extracted from PAJ database, dated Mar. 12, 2010, 32 pages.
English language translation and abstract for JP 2004-028525 extracted from PAJ database, dated Mar. 22, 2010, 39 pages.
English language translation and abstract for JP 2005-299949 extracted from PAJ database, dated Mar. 12, 2010, 44 pages.
INPI Institut National De La Propriete Industrielle Search Report for FA716847/FR0807423, dated Jun. 4, 2009, 1 page.

* cited by examiner

COMBINED DEVICE HAVING AN INTERNAL HEAT EXCHANGER AND AN ACCUMULATOR, AND EQUIPPED WITH AN INTERNAL MULTI-FUNCTION COMPONENT

RELATED APPLICATIONS

This application claims priority to and all the advantages of French Patent Application No. FR 08/07423, filed on Dec. 22, 2008.

TECHNICAL FIELD OF THE INVENTION

This invention relates to the field of air conditioning loops cooperating with a heating, ventilation and/or air conditioning system of a motor vehicle. It relates to a combined device associating an internal heat exchanger with an accumulator involved in such a loop. It also relates to an air conditioning loop including such a combined device.

PRIOR ART

Motor vehicles are commonly equipped with a heating, ventilation and/or air conditioning system in order to regulate the aerothermal parameters of the air contained in the vehicle interior. The system consists primarily of a casing made of a plastic material, which is housed below an instrument panel of the vehicle. The casing channels the circulation of at least one air flow prior to delivering it to the vehicle interior.

Such a system cooperates with an air conditioning loop in order to cool the air flow before it is discharged from the casing to the vehicle interior. Said loop includes a plurality of elements in which a coolant, such as a supercritical fluid, in particular carbon dioxide known as R744, circulates. These elements include at least one compressor, a gas cooler, an internal heat exchanger, an expansion member, an evaporator and an accumulator.

The coolant circulates from the compressor to the gas cooler, then through a "high-pressure" branch of the internal heat exchanger, then to the expansion member, then through the evaporator, then to the accumulator, and finally through a "low-pressure" branch of the internal heat exchanger, in order to return to the compressor.

The compressor is intended to receive the coolant in the gaseous state and to compress it in order to bring it to high pressure. The gas cooler is capable of cooling the compressed coolant, at a relatively constant pressure, by transferring the heat to the environment. The expansion member is capable of reducing the pressure of the coolant leaving the gas cooler by bringing it at least partially to the liquid state. The evaporator is suitable for converting the coolant from the gaseous state to the liquid state coming from the expansion member, at a relatively constant pressure, by drawing heat in said air flow passing through the evaporator. The vaporized coolant is then suctioned by the compressor. These arrangements are such that the coolant is at high pressure inside the "high-pressure" branch of the internal heat exchanger while it is at low pressure inside the "low-pressure" branch of the internal heat exchanger.

The accumulator performs a function of separation between a gaseous phase and a liquid phase of the coolant. To this end, the accumulator comprises a separation area inside of which said phases separate from one another by gravity.

The accumulator also performs a function of storing a circulating load of coolant according to the conditions of use of the air conditioning loop. For this, the accumulator comprises an area for accumulation of the coolant in liquid state, which the accumulation area collects from the separation area.

In general, the accumulator consists of a chamber housing the separation area and the accumulation area, and the chamber includes a lower partition that delimits the accumulation area in the bottom portion of the chamber. Thus, the coolant in liquid state coming from the evaporator separates into a gaseous phase and a liquid phase, the latter of which accumulates by gravity above the lower partition, inside the accumulation area.

The internal heat exchanger is configured so that the coolant circulating inside the "high-pressure" branch can transfer heat to the coolant circulating inside the "low-pressure" branch.

Document JP10019421 (NIPPON SOKEN; DENSO CORP) proposes combining the internal heat exchanger and the accumulator in a combined device. In general, the latter includes said chamber, which is equipped with an opening closed by a lid. The chamber houses the internal heat exchanger, which hangs over the accumulation area for the coolant in the liquid state in the position of use of the combined device on the air conditioning loop.

Such a combined device has disadvantages with regard to excessive structural complexity, and should be simplified.

More specifically, such a combined device consists of a suitable number of separate parts, thereby leading to manufacturing costs that should be reduced.

Again more specifically, such a combined device is bulky and should be made more compact.

Moreover, in the common case in which an oil is added to the coolant circulating inside said loop, the arrangement of such a combined device does not provide storage or reintegration inside said loop.

Finally, such a combined device should be improved with regard to multiple functions that it performs. More specifically, such a combined device should be optimized in particular to:

- facilitate or improve a separation of the gaseous and liquid phases of the coolant coming from the evaporator,
- improve the circulation of the coolant inside a "low-pressure" branch in order to optimize a heat exchange between the coolant circulating inside the "low-pressure" branch and the coolant circulating inside a "high-pressure" branch,
- enable easy and quick production of the various elements constituting said combined device, and
- enable easy and quick assembly of these various elements with one another.

OBJECTIVE OF THE INVENTION

A first objective of this invention is to propose a combined device associating an internal heat exchanger and an accumulator involved in an air conditioning loop, wherein said combined device is arranged to:

- facilitate or improve a separation of the gaseous and liquid phases of a coolant circulating inside such a loop,
- improve the circulation of the coolant inside a "low-pressure" branch of the internal heat exchanger in order to optimize a heat exchange between the coolant circulating inside said "low-pressure" branch and the coolant circulating inside a "high-pressure" branch of the internal heat exchanger, improve the seal between various components that the combined device comprises, provide an optimized oil reserve and facilitate reinjection of the oil in the air conditioning loop, enable easy and quick production of the various elements constituting said combined device, and enable easy and quick assembly of these various elements with one another.

A second objective of this invention is to propose an air conditioning loop including such a combined device, in which the arrangement of the latter facilitates its integration on the air conditioning loop in certain designs of the latter and improves a coefficient of performance ("COP") of said loop.

The device of this invention is a combined device including a chamber consisting of an upper partition, a lower partition and at least one peripheral wall. Said chamber houses an internal heat exchanger, a separation area and an accumulation area. The chamber also houses a one-piece internal component that consists of:

a wall delimiting the separation area and the accumulation area, a wall confining the internal heat exchanger with respect to the accumulation area, and a conduit that connects the confinement wall to the delimiting wall.

The conduit advantageously comprises a first end equipped with a first opening that is provided through the delimiting wall and a second end equipped with a second opening that is provided through the confinement wall.

The delimiting wall is preferably equipped with a collar that surrounds the first opening.

The collar advantageously bells out toward the separation area.

The delimiting wall is preferably designed as a disk of which the center is equipped with the first opening and of which an edge is equipped with at least one lug for positioning the delimiting wall against the peripheral wall of the chamber.

The confinement wall comprises in particular an internal face that is arranged opposite the separation wall.

The internal face is, for example, convex when viewed from the delimiting wall.

The internal face is, for example, also provided in the form of a dish comprising a center of curvature C, indifferently arranged between the delimiting wall and the confinement wall or above the delimiting wall.

The dish advantageously comprises a base provided in the form of a drain.

The confinement wall preferably comprises an internal edge equipped with a first slot for receiving a first seal between the confinement wall and a central crown constituting the internal heat exchanger.

The confinement wall preferably comprises an external edge equipped with a second slot for receiving a second seal between the confinement wall and said peripheral wall.

According to an alternative embodiment, at least one channel is provided between the internal face and an internal volume of the conduit.

According to another alternative embodiment, at least one capillary is provided between the internal face and an external face of the confinement wall, in which the external face is opposite said internal face.

The external face is advantageously equipped with a recess for the passage of an upper cap provided on a "low-pressure" collector of the internal heat exchanger.

The confinement wall is preferably equipped with a skirt for at least partially surrounding the internal heat exchanger.

The skirt is, for example, provided with grooves for contact of the skirt against said peripheral wall.

The skirt is, for example, also equipped with a lower border for contact against the lower partition of the chamber.

The skirt is in particular equipped with at least one window for receiving at least one corresponding finger that is provided on a lower plate of the internal heat exchanger.

An air conditioning loop of this invention is characterized primarily in that said loop includes such a combined device.

As a supercritical coolant passes through the air conditioning loop, said loop is characterized in that:

the separation area constitutes an area of separation between a gaseous phase of the coolant and a liquid phase of the coolant, and the accumulation area constitutes an area for storage of the liquid phase of the coolant coming from the separation area.

Preferably, the combined device includes:

a "high-pressure" circulation path extending between a "high-pressure" inlet provided through the lower partition of the chamber and a "high-pressure" outlet provided through the upper partition of the chamber, wherein the "high-pressure" circulation path consists primarily of a "high-pressure" branch of the internal heat exchanger and a "high-pressure" collector of the internal heat exchanger, and the "high-pressure" collector is at least partially housed inside an internal volume of the conduit, a "low-pressure" circulation path extending between a "low-pressure" inlet provided through the upper partition of the chamber and a "low-pressure" outlet provided through the lower partition of the chamber, wherein the "low-pressure" circulation path includes a "low-pressure" branch of the internal heat exchanger, the internal volume of the conduit and the separation area.

The conduit advantageously constitutes a complementary heat exchange area between the low-pressure coolant circulating inside the internal volume of the conduit and the high-pressure coolant circulating inside the "high-pressure" collector.

DESCRIPTION OF THE FIGURES

This invention can be better understood, and the relevant details will become clear, in view of the following description of various embodiments, in association with the appended figures, wherein:

In FIG. 1, a heating, ventilation and/or air conditioning system of a motor vehicle cooperates with an air conditioning loop 1 in order to cool an air flow 2 before the latter is delivered to the vehicle interior. The air conditioning loop 1 includes a compressor 3, a gas cooler 4, an internal heat exchanger 5, an expansion member 6, an evaporator 7 and an accumulator 8 in which a coolant circulates, such as a supercritical fluid, in particular carbon dioxide known as R744. An additive, such as a lubricating oil, is mixed with the coolant in order to maintain the operation of the compressor 3, wherein the lubricating oil has a density greater than that of the coolant.

Figure 1:
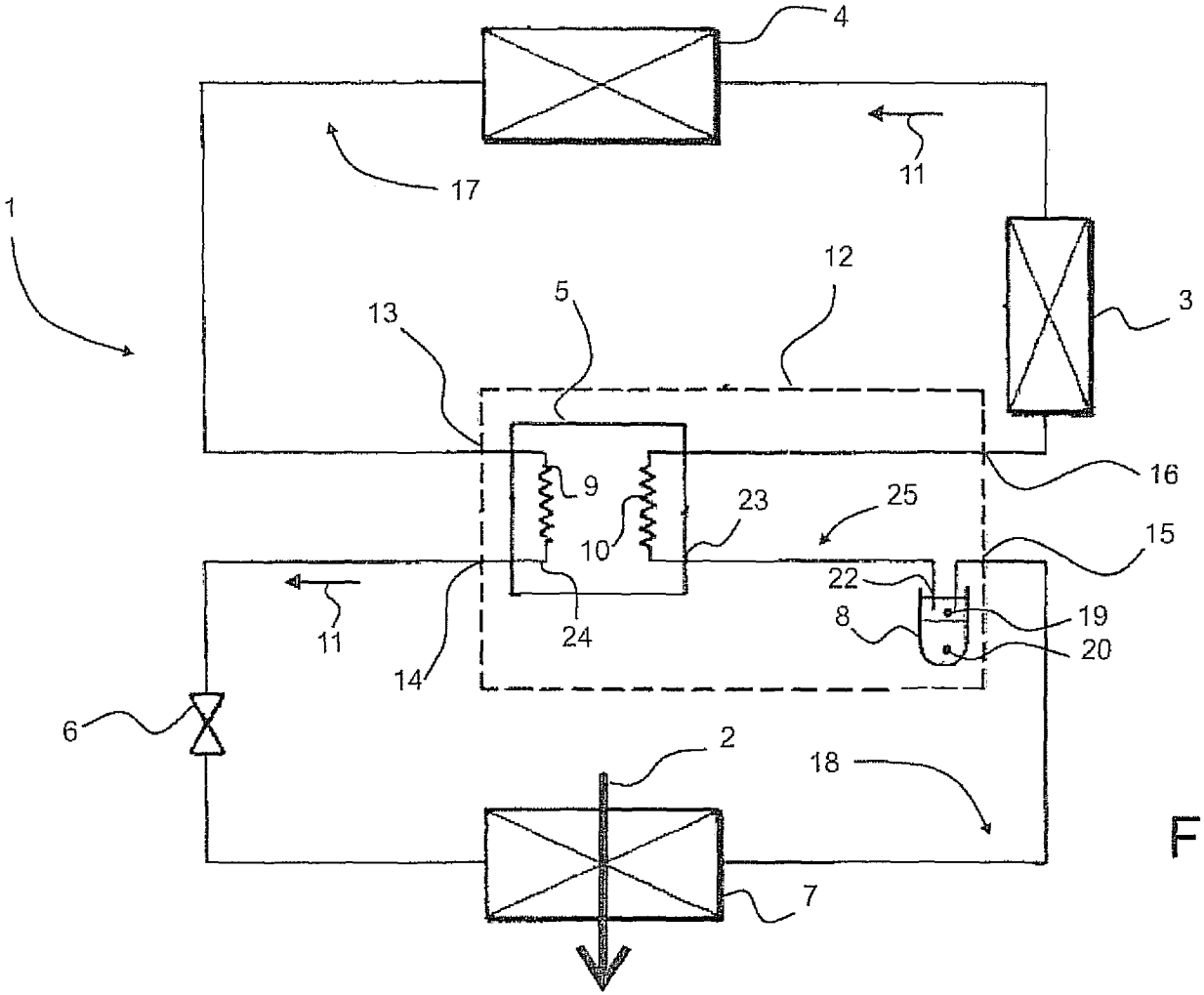
FIG. 1 is a diagrammatic illustration of an air conditioning loop including a combined device according to his invention.

The coolant circulates from the compressor 3 to the gas cooler 4, then through a "high-pressure" branch 9 of the internal heat exchanger 5, then toward the expansion member 6, then through the evaporator 7, then to the accumulator 8, and finally through a "low-pressure" branch 10 of the internal heat exchanger 5, in order to return to the compressor 3. These arrangements enable a heat exchange between the coolant circulating at high pressure and a high temperature inside said "high-pressure" branch 9 and the coolant circulating at low pressure and at low temperature inside said "low-pressure" branch 10. This results in an improvement in the coefficient of performance ("COP") of the air conditioning loop 1.

The air conditioning loop 1 includes a "high-pressure" line 17 that begins at the outlet of the compressor 3 and ends at the inlet of the expansion member 6, according to a direction of circulation 11 of the coolant inside the air conditioning loop 1, wherein the gas cooler 4 and the "high-pressure" branch 9 of the internal heat exchanger 5 are inserted between these two points.

The air conditioning loop 1 also includes a "low-pressure" line 18 that starts at the outlet of the expansion member 6 and ends at the inlet of the compressor 3, according to the direction of circulation 11 of the coolant inside the air conditioning loop 1, in which the evaporator 7, the accumulator 8 and the "low-pressure" branch 10 of the internal heat exchanger 5 are inserted between these two points.

The accumulator 8, arranged downstream of the evaporator 7 according to the direction of circulation 11 of the coolant inside the air conditioning loop 1, enables a separation of a gaseous phase and a liquid phase of the coolant coming from the evaporator 7 and then recovery of the coolant and the lubricating oil in the liquid state. To this end, the accumulator 8 comprises a separation area 19 for separating said phases and an accumulation area 20 for collecting the liquid phase.

The internal heat exchanger 5 and the accumulator 8 are associated in a combined device 12 forming a one-piece assembly jointly performing the functions of the internal heat exchanger 5 and the accumulator 8. The combined and one-piece natures of said device 12 enable the internal heat exchanger 5 and the accumulator 8 to be installed simultaneously on the air conditioning loop 1, wherein the internal heat exchanger 5 and the accumulator 8 form an integrated assembly. This makes it possible to do away with a conduit installed in the engine compartment of the vehicle, between an outlet 22 of the accumulator 8 and an inlet 23 of the "low-pressure" branch 10 of the internal heat exchanger 5.

The combined device 12 comprises a "high-pressure" inlet 13 through which the coolant coming from the gas cooler 4 is admitted inside the combined device 12. The combined device 12 also comprises a "high-pressure" outlet 14 through which the coolant at high pressure is discharged from the combined device 12 toward the expansion member 6. The "high-pressure" inlet 13 and the "high-pressure" outlet 14 are connected to one another by means of a "high-pressure" circulation path 24, which includes the "high-pressure" branch 9.

The combined device 12 also comprises a "low-pressure" inlet 15, through which the coolant coming from the evaporator 7 is admitted inside the combined device 12. The combined device 12 finally comprises a "low-pressure" outlet 16 through which the coolant at low pressure is discharged from the combined device 12 toward the compressor 3. The "low-pressure" inlet 15 and the "low-pressure" outlet 16 are connected to one another by means of a "low-pressure" circulation path 25, which includes the "low-pressure" branch 10 of the internal heat exchanger 5 and the separation area 19.

Figure 3:
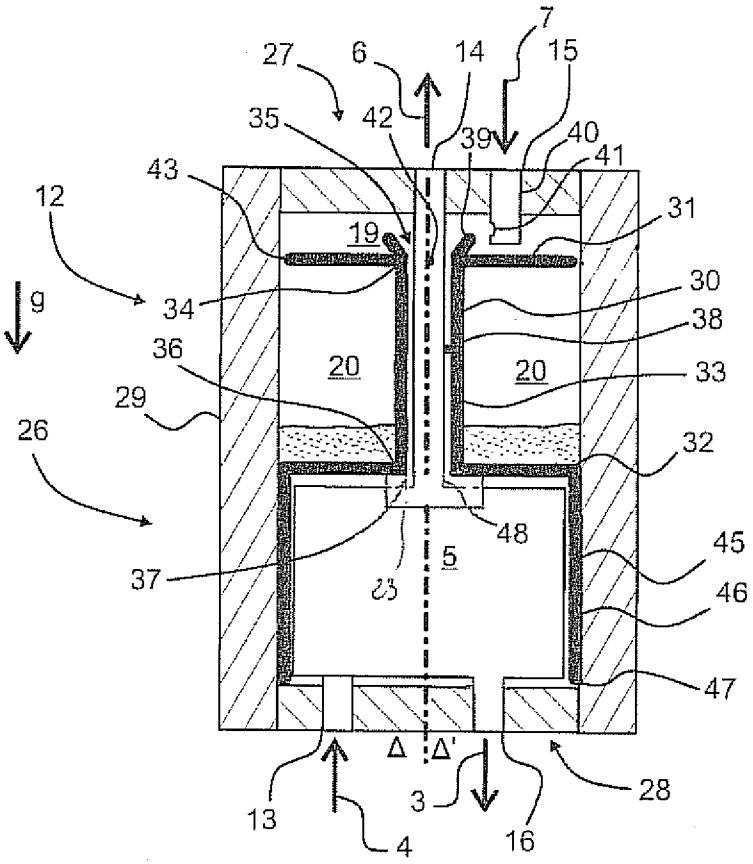
FIGS. 2 and 3 are diagrammatic illustrations, in a longitudinal cross-section, of respective alternative embodiments of the combined device shown in the previous figure.
Figure 2:
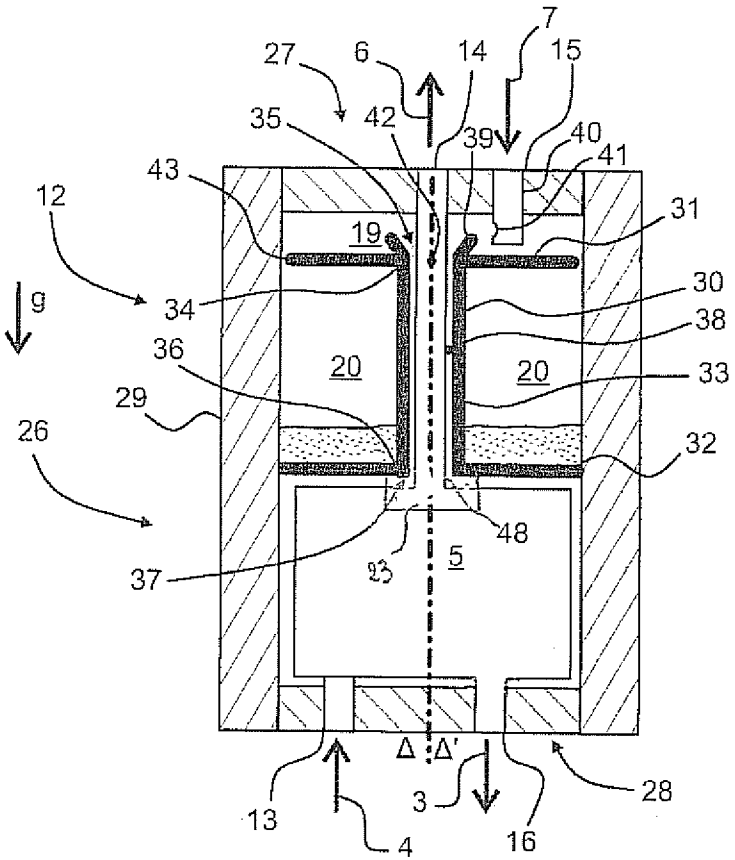

In FIGS. 2 and 3, the combined device 12 includes a chamber 26 that consists of an upper partition 27, a lower partition 28 and at least one peripheral wall 29. The latter is in particular designed as an elongate tube of which the ends are closed by an upper lid forming the upper partition 27 and a lower lid forming the lower partition 28. The chamber 26 houses the internal heat exchanger 5, the separation area 19 and the accumulation area 20.

The general problem arises of the mutual arrangement of said separation 19 and accumulation 20 areas, the internal heat exchanger 5 and the general design of the combined device 12 in order to best ensure the intended functions thereof, namely in particular the separation of said phases, the storage of the coolant and/or said oil, and the reintegration of the latter upstream of the compressor 3.

According to this invention, the chamber 26 houses an internal one-piece component 30, which is formed by a delimiting wall 31 delimiting the separation area 19 and the accumulation area 20, a confinement wall 32 for confining the internal heat exchanger 5 with respect to the accumulation area 20, and a conduit 33 that connects the confinement wall 32 and the delimiting wall 31.

The designers of this invention chose to assign, to a single internal one-piece component 30, all or an active participation in the aforementioned functions of the combined device. This choice enables the assembly operations of said combined device 12 to be facilitated, reduces the bulk and weight of the latter, and said internal one-piece component 30 can easily be produced at a lower cost.

The one-piece nature of the internal component 30 is characterized in that the internal component 30 is formed by an integral assembly 31, 32, 33 consisting of said delimiting wall 31, said confinement wall 32 and said conduit 33, wherein the integral assembly 31, 32, 33 is capable of being installed jointly inside the chamber 26 in a single assembly operation. According to a first embodiment, the integral assembly 31, 32, 33 consists of a single piece made, for example by injection of a plastic material. According to other embodiments, the integral assembly 31, 32, 33 consists of two parts assembled by nesting, bonding or the like and consisting respectively, for example, of the delimiting wall 31 and the conduit 33, which make it a one-piece assembly and of the confinement wall 32, or consisting, for example, again, of the delimiting wall 31 and of the conduit 33 and the confinement wall 32, which make it a one-piece assembly.

The delimiting wall 31 partially isolates the separation area 19 and an accumulation area 20 from one another. The delimiting wall 31 is inserted between the separation area 19 and the accumulation area 20.

The confinement wall 32 isolates the accumulation area 20 and the heat exchanger 5 from one another. The latter is inserted between the confinement wall 32 and the lower partition 28. It is clear that the accumulation area 20 is itself inserted between the delimiting wall 31 and the confinement wall 32.

The conduit 33 is inserted between the delimiting wall 31 and the confinement wall by extending inside the accumulation area 20. The conduit 33 comprises a first end 34 equipped with a first opening 35 that is provided through the delimiting wall 31 and a second end 36 equipped with a second opening 37 that is provided through the confinement wall 32. The conduit 33 delimits an internal volume 38 that is in aeraulic communication with the separation area 19 by means of the first opening 35 and with the internal heat exchanger 5 by means of the second opening 37. These arrangements are such that the internal volume 38 of the conduit 33 constitutes a passage for the coolant in the gaseous state from the separation area 19 to the inlet 23 of the "low-pressure" branch 10 of the internal heat exchanger 5.

The delimiting wall 31 is equipped with a collar 39 that is provided around the first opening 35 by belling out from the delimiting wall 31 toward the separation area 19. These arrangements are intended to facilitate intake of the coolant in the gaseous state into the internal volume 38 of the conduit 33 and to prevent intake of the coolant in the liquid state into said internal volume 38. The end result is that the coolant coming from the evaporator 7 is separated by a cyclone effect into gas and liquid after being admitted into the separation area 19 by means of a nozzle 40 provided at the "low-pressure" inlet 15 of the combined device 12. The nozzle 40 is, for example, designed as a cylinder equipped with a tangential orifice 41 in order to facilitate said separation between the coolant in the liquid state and the coolant in the gaseous state. The coolant in the liquid state tends to fall under gravity from the nozzle 40 to the delimiting wall 31 while the coolant in the gaseous state disperses inside the separation area 19 until in particular it penetrates the interior of said internal volume 38.

The delimiting wall 31 is designed as a disk of which the center 42 is equipped with the first opening 35 and of which an edge 43 is equipped with lugs 44 for positioning the delimiting wall 31 against the peripheral wall 29 of the chamber 26.

More specifically, in FIG. 3, the confinement wall 32 is equipped with a skirt 45 for at least partially surrounding the internal heat exchanger 5. The skirt 45 covers the internal heat exchanger 5 and isolates it from the peripheral wall 29 of the chamber 26. The skirt 45 is, for example, equipped with grooves 46 for contact of the skirt 45 against said peripheral wall 29. The skirt 45 comprises a lower border 47 for contact against the lower partition 28 of the chamber 26.

These arrangements are such that the "high-pressure" circulation path 24, which extends between the "high-pressure" inlet 13, which is provided through the lower partition 28 of the chamber 26, and the "high-pressure" outlet 14, which is provided through the upper partition 27 of the chamber 26, passes through the combined device 12 from one side to the other, generally parallel to an axis of longitudinal extension Δ of said combined device 12, from the bottom to the top in FIGS. 2 and 3, i.e. in the direction opposite gravity g.

These arrangements area also such that the "low-pressure" circulation path 25, which extends between the "low-pressure" inlet 15, which is provided through the upper partition 27 of the chamber 26, and the "low-pressure" outlet 16, which is provided through the lower partition 28 of the chamber 26, passes through the combined device 12 from one side to the other, generally parallel to the axis of longitudinal extension Δ of said combined device 12, from the top to the bottom in FIGS. 2 and 3, i.e. in the direction of gravity g.

An exception to this extension of the "high-pressure" 24 and "low-pressure" 25 circulation paths lies in the exchange that occurs in the internal heat exchanger 5, as will be described in reference to FIG. 5.

Finally, this results in a characteristic of the invention that lies in the fact that the upper partition 27 is that equipped with the nozzle 40. In other words, the identification of the nozzle 40 in the combined device 12 determines that of the partitions 27, 28, which is the so-called upper partition, either in the position of use of the combined device 12 or in the actual position of operation thereof.

According to a preferred embodiment of this invention, the upper partition 27 is designed as a retractable upper lid and equipped with the "low-pressure" inlet 15 and the "high-pressure" outlet 14, while the lower partition 28 is designed as a retractable lower lid and equipped with the "high-pressure" inlet 13 and the "low-pressure" outlet 16.

Figure 4:
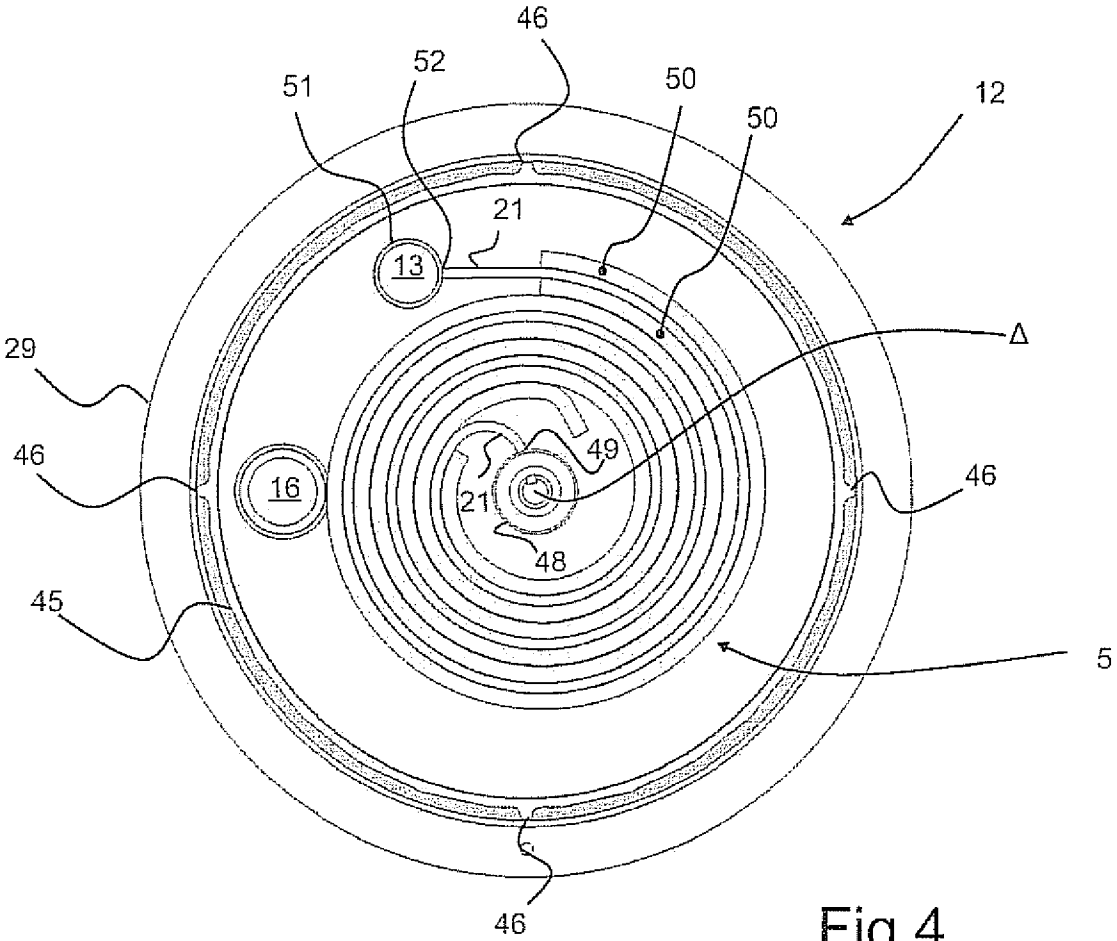
FIG. 4 is a transverse cross-section view of the combined device shown in FIG. 3.

In FIG. 4, which shows a transverse cross-section of the combined device 12 according to FIG. 3 at the level of the internal heat exchanger 5, the "high-pressure" inlet 13 is in communication with a peripheral "high-pressure" collector 51, which is associated with a peripheral end 52 of a flat tube 21. The latter is wound on itself about the axis of longitudinal extension Δ to a central end 49 of said flat tube 21. Said central end 49 is equipped with a central "high-pressure" collector 48 that is housed at least partially inside the conduit 33. The conduit 33 thus constitutes a complementary area of heat exchange between the coolant at low pressure circulating inside the internal volume 38 of the conduit 33 and the coolant at high pressure circulating inside the central "high-pressure" collector 48. This results in an increase on the order of 3% to 7% of the thermal exchange efficiency with respect to an internal heat exchanger 5 not equipped with a central "high-pressure" collector 48 housed inside the internal volume 38 of a conduit 33 such as an internal one-piece component 30.

The flat tube 21 is bordered by two secondary flat tubes 50 inside of which the coolant circulates at low pressure. According to another alternative embodiment, the flat tube 21 is bordered by a single secondary flat tube 50, which is indifferently internal or external. According to yet another alternative embodiment, the flat tube 21 is simply washed in the coolant at low pressure, which flows inside an interstitial space provided between two consecutive turns of the winding of the flat tube 21 on itself.

Figure 5:
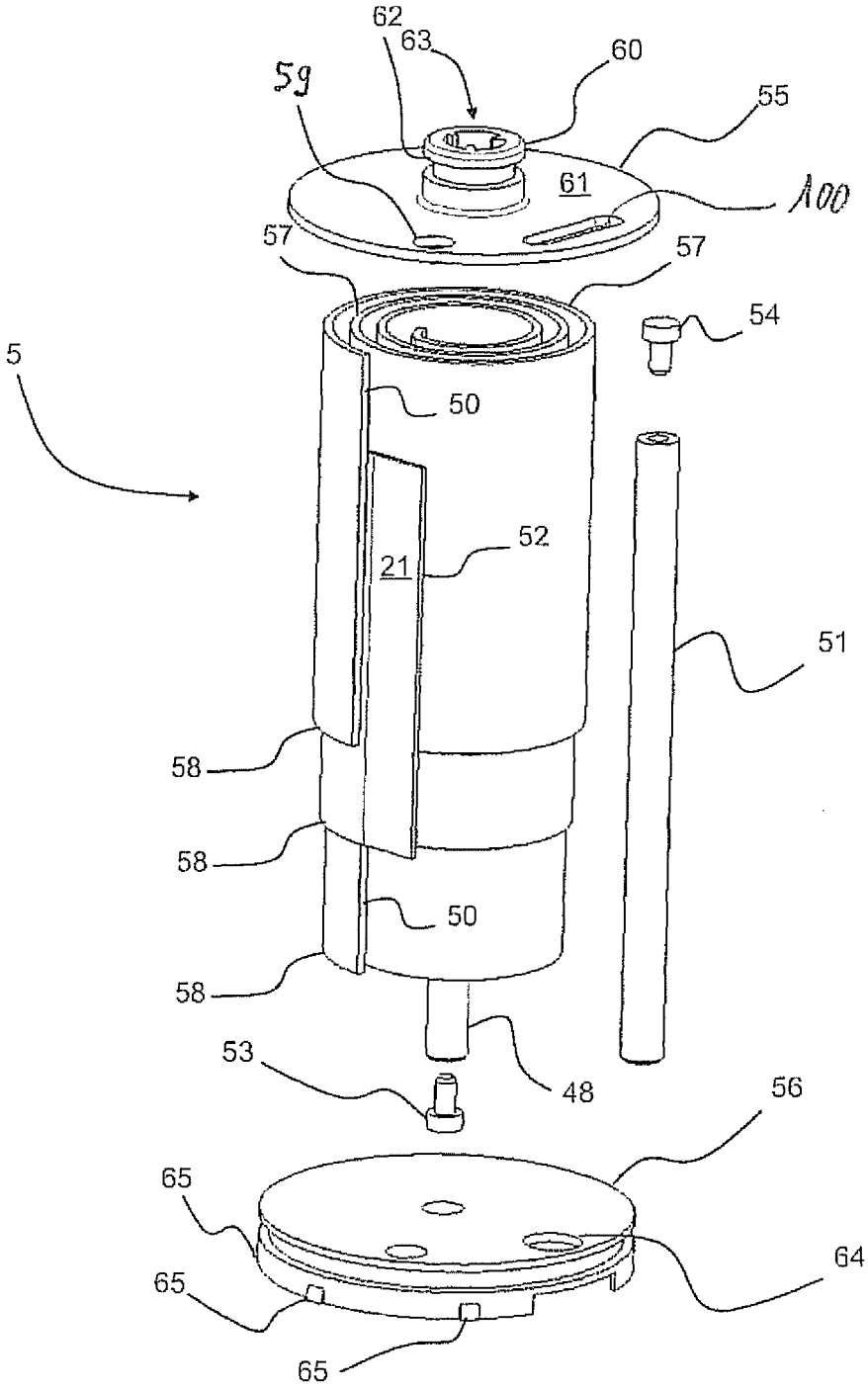
FIG. 5 is an exploded perspective view of an internal heat exchanger constituting said combined device.

In FIG. 5, the central "high-pressure" collector 48 is arranged in a central tube equipped with a lower cap 53, and the peripheral "high-pressure" collector 51 is arranged in a peripheral tube equipped with an upper cap 54. The internal heat exchanger 5 comprises an upper plate 55 for covering the winding of the flat tube 21, and optionally the secondary flat tube(s) 50, and a lower plate 56 for covering the winding of the flat tube 21 and optionally the secondary flat tube(s) 50. The upper plate 55 and the lower plate 56 are respectively in contact with the upper 57 and lower 58 sections of the flat tube 21 and optionally the secondary flat tube(s) 50.

Said upper plate 55 is equipped with an orifice 59 for the passage through same of the upper cap 54, which emerges beyond the upper plate 55. The upper plate 55 is also equipped with a central crown 60 provided on an external face 61 of the upper plate 55, wherein said external face 61 is the one free of contact with the flat tube 21 and optionally the secondary flat tube(s) 50. The central crown 60 is equipped with a groove 62 for receiving a first seal, which can be seen in FIG. 8. The central crown 60 comprises a passage 63 for the central "high-pressure" collector 48 to pass through. The upper plate 55 finally comprises an oblong hole 100 of which the function is to allow the passage of the oil that accumulates between the external face 77 of the confinement wall 32 and the upper plate 55 in order to direct it toward the "low-pressure" outlet 16, when the internal one-piece component is used as shown in FIG. 9 or 10.

Said lower plate 56 is equipped with a hole 64 that is opposite said "low-pressure" outlet 16 for discharge of the coolant from the combined device 12 to the compressor 3. Said lower plate 56 is also equipped with fingers 65 provided on a section of said lower plate 56 for the nesting thereof inside corresponding windows 66 provided on the skirt 45. Said windows can be seen in FIG. 6.

Figure 6:
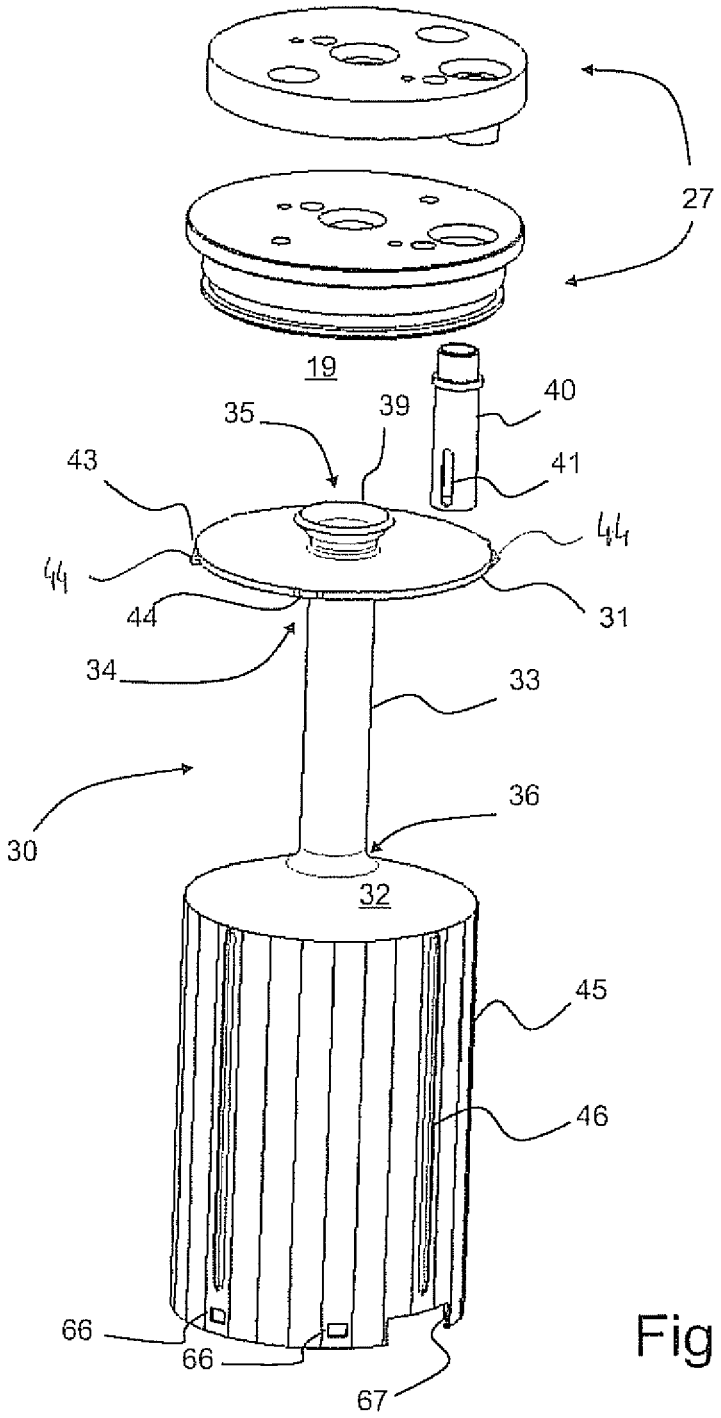
FIG. 6 is an exploded perspective view of an internal component involved in the combined device shown in the previous figure.

In FIG. 6, the skirt 45 is provided with an indentation 67 for the passage of coolant at low pressure on either side of the skirt 45, and thus enables recovery of the coolant that has flown between the skirt 45 and the peripheral wall 29 of the chamber 26.

Figure 7:
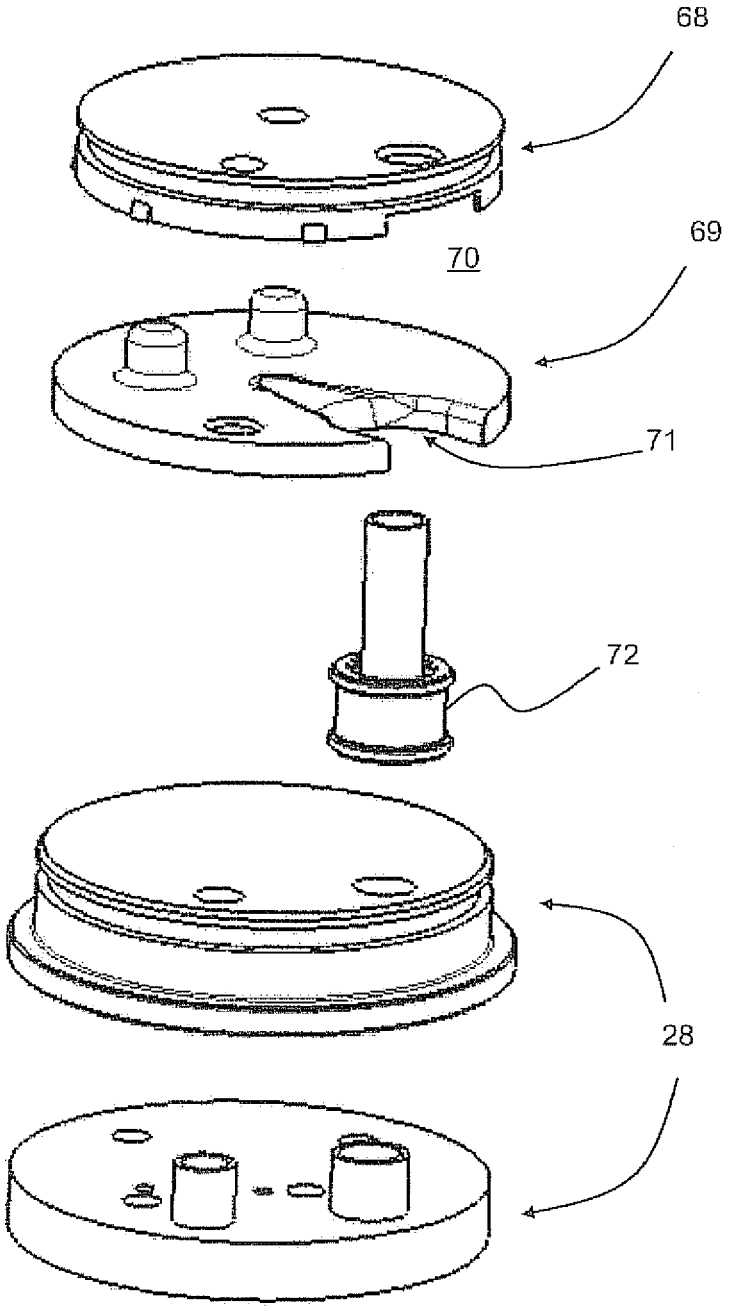
FIG. 7 is an exploded perspective view of a bottom portion of said combined device.

In FIG. 7, said lower plate 56 consists of two basic plates 68, 69, including an upper basic plate 68 and a lower basic plate 69. An oil reserve is provided between the upper basic plate 68 and the lower basic plate 69. The lower basic plate 69 is provided with a radial indentation 71 for receiving an oil filter 72.

Figure 8:
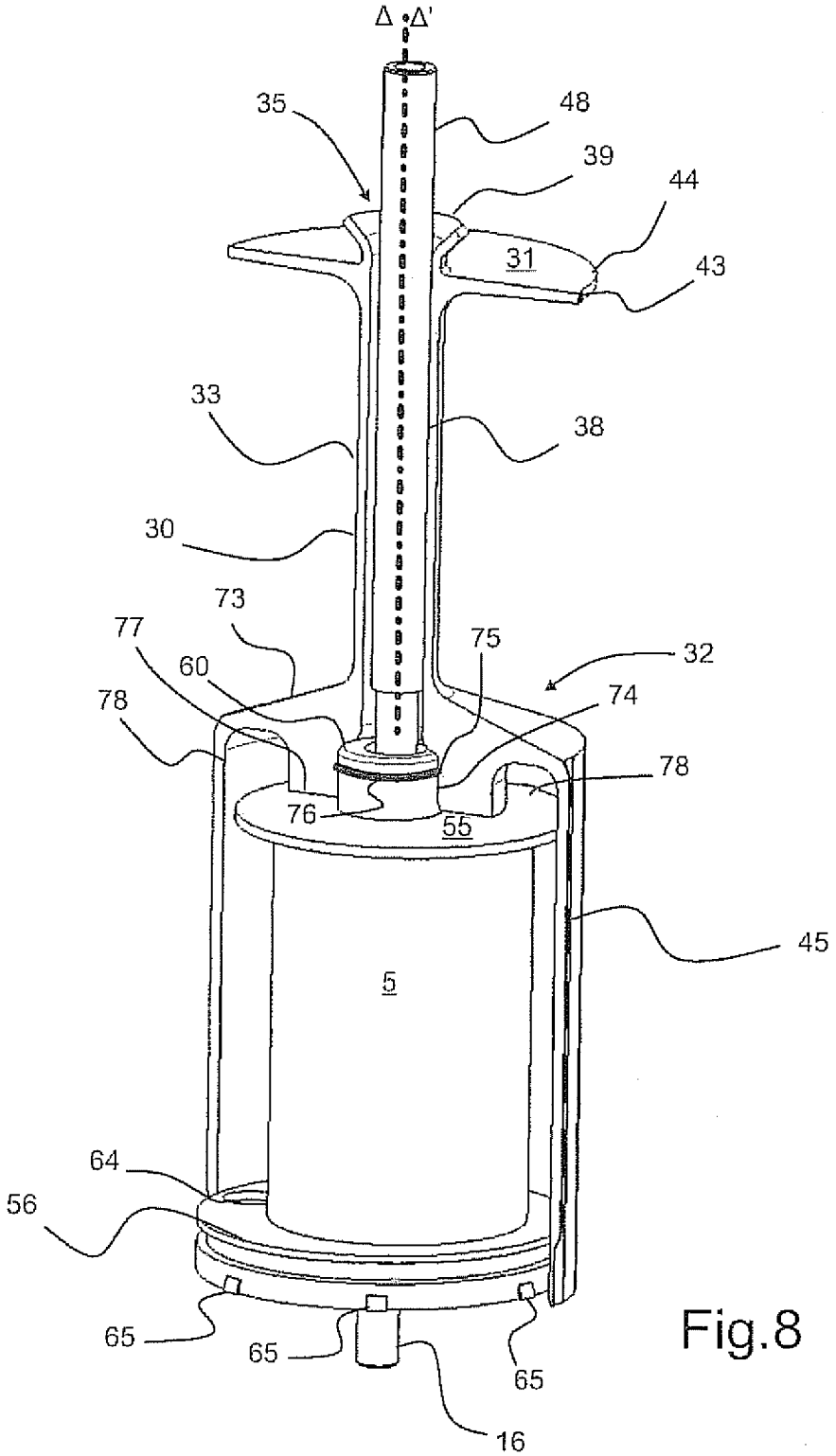
FIG. 8 is a partial cut-away perspective view of said combined device.
Figure 9:
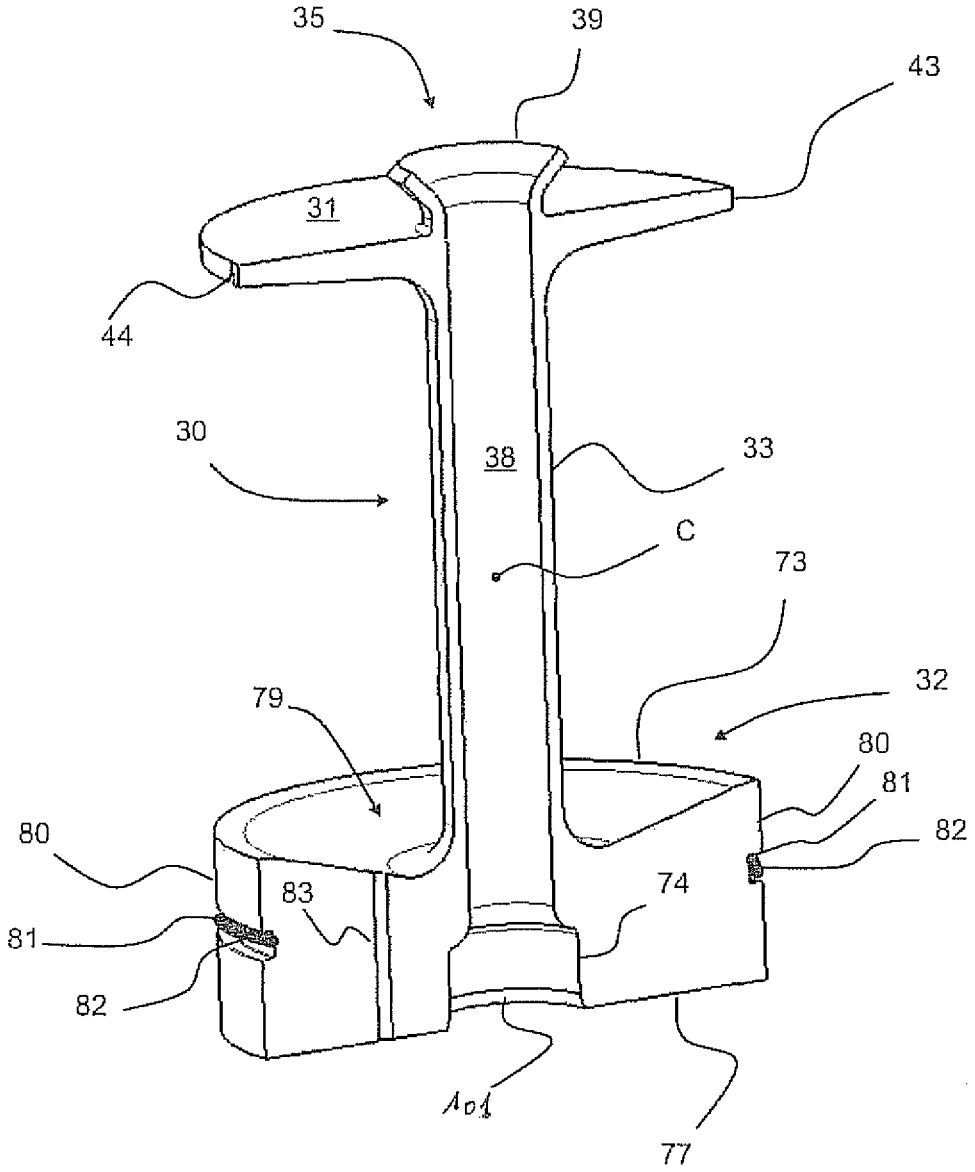
FIG. 9 is a perspective view of a first alternative embodiment of an internal component constituting said combined device.
Figure 10:
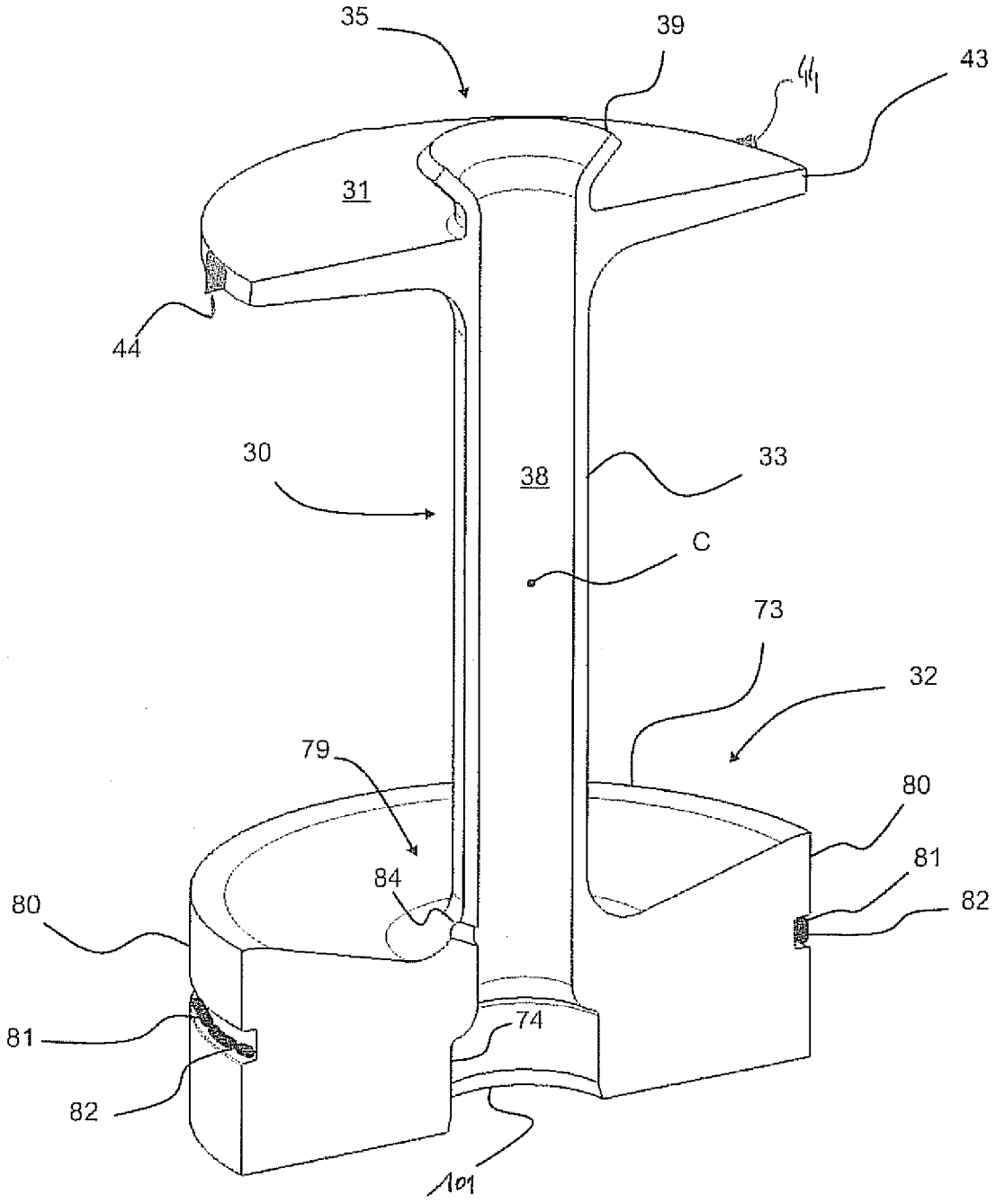
FIG. 10 is a perspective view of a second alternative embodiment of an internal component constituting said combined device.

In FIGS. 8 to 10, the confinement wall 32 comprises an internal face 73 that is provided opposite the delimiting wall 31, wherein the confinement wall 32 and the delimiting wall 31 are generally parallel to one another while being substantially orthogonal to said axis of longitudinal extension Δ of said combined device 12 and to an axis of symmetry Δ of the conduit 33.

More specifically, in FIG. 8, the internal face 73 is convex when seen from the delimiting wall 31, so that the lubricating oil accompanying the coolant in the liquid state can easily flow along the internal face 73 in order to spread between the peripheral wall 29 and the skirt 45, and reach said "low-pressure" outlet 16 through said radial indentation 71.

The confinement wall 32 comprises an internal edge 74 provided with a first slot 75 for receiving said first seal 76 between the confinement wall 32 and the central crown 60 constituting the internal heat exchanger 5.

The confinement wall 32 comprises an external face 77, opposite the internal face 73, which is provided with a recess 78 for the passage of the upper cap 54 provided on the "high-pressure" collector 51 of the internal heat exchanger 5.

In FIGS. 9 and 10, the internal face 73 is designed as a dish comprising a center of curvature C, inserted between the delimiting wall 31 and the confinement wall 32. According to another embodiment, the center of curvature C is placed above the delimiting wall. The internal face 73 comprises a base 79 provided in the form of a drain so as to collect the oil that circulates with the coolant. In addition, the confinement wall 32 comprises an external edge 80 equipped with a second slot 81 for receiving a second seal 82 between the confinement wall 32 and said peripheral wall 29.

In FIG. 9, a channel 83 is provided between the internal face 73 and the external face 77 of the confinement wall 32. Such a channel 83, which extends from the internal face 73 to the external face 77 of the confinement wall 32 enables reintegration of the lubricating oil at the level of said "low-pressure" outlet 16 of the combined device 12, i.e. downstream of the internal heat exchanger 5 according to a direction of circulation 11 of the coolant inside the air conditioning loop 1. These provisions limit the head losses inside the internal heat exchanger 5 due to the presence of oil, which is an advantage. The presence of a chamfer 101 formed at the junction between the external face 77 and the internal edge 74 should finally be noted.

In FIG. 10, a hole 84 is provided between the internal face 73 and an internal volume 38 of the conduit 33. Such a hole 84 enables reintegration of the lubricating oil at the level of said inlet 23 of the "low-pressure" branch 10 of the internal heat exchanger 5, i.e. upstream of the internal heat exchanger 5 in a direction of circulation 11 of the coolant inside the air conditioning loop 1.

The invention claimed is:

1. A combined device (12) including a chamber (26) comprising an upper partition (27), a lower partition (28) and at least one peripheral wall (29), wherein the chamber (26) houses an internal heat exchanger (5), a separation area (19), and an accumulation area (20), characterized in that the chamber (26) also houses a one-piece internal component (30) that comprises:

- a delimiting wall (31) that separates the separation area (19) from the accumulation area (20), wherein the delimiting wall (31) is equipped with a collar (39) that surrounds a first opening (35) and comprises a disk shape of which the center (42) is equipped with the first opening (35);
- a confinement wall (32) that isolates the internal heat exchanger (5) from the accumulation area (20); and
- a conduit (33) that connects the confinement wall (32) to the delimiting wall (31), wherein the conduit (33) comprises a first end (34) equipped with the first opening (35) that is provided through the delimiting wall (31).

2. The combined device (12) according to claim 1, characterized in that a second end (36) equipped with a second opening (37) that is provided through the confinement wall (32).

3. The combined device (12) according to claim 1, characterized in that the collar (39) bells out toward the separation area (19).

4. The combined device (12) according to claim 1, characterized in that an edge (43) is equipped with at least one lug (44) for positioning the delimiting wall (31) against the peripheral wall (29) of the chamber (26).

5. The combined device (12) according to claim 1, characterized in that the confinement wall (32) comprises an internal face (73) that is arranged opposite the delimiting wall (31).

6. The combined device (12) according to claim 5, characterized in that the internal face (73) is convex when viewed from the delimiting wall (31).

7. The combined device (12) according to claim 5, characterized in that the internal face (73) is provided in the form of a dish comprising a center of curvature (C), arranged between the delimiting wall (31) and the confinement wall (32), or above the delimiting wall (31).

8. The combined device (12) according to claim 5, characterized in that at least one hole (84) is provided between the internal face (73) and an internal volume (38) of the conduit (33).

9. The combined device (12) according to claim 5, characterized in that at least one capillary (83) is provided between the internal face (73) and an external face (77) of the confinement wall (32), in which the external face (77) is opposite said internal face (73).

10. The combined device (12) according to claim 1, characterized in that the confinement wall (32) comprises an internal edge (74) equipped with a first slot (75) for receiving a first seal (76) between the confinement wall (32) and a central crown (60) constituting the internal heat exchanger (5).

11. The combined device (12) according to claim 10, characterized in that the confinement wall (32) comprises an external edge (80) equipped with a second slot (81) for receiving a second seal (82) between the confinement wall (32) and the peripheral wall (29).

12. The combined device (12) according to claim 1, characterized in that the confinement wall (32) is equipped with a skirt (45) for at least partially surrounding the internal heat exchanger (5).

13. An air conditioning loop (1) including a combined device (12) according to claim 1.

14. The air conditioning loop (1) according to claim 13 through which a supercritical coolant passes, characterized in that:

the separation area (19) constitutes an area of separation between a gaseous phase of the coolant and a liquid phase of the coolant, and the accumulation area (20) constitutes an area for storage of the liquid phase of the coolant coming from the separation area (19).

15. The combined device (12) according to claim 1, wherein the internal heat exchanger (5) is located in the lower partition (28).

16. The combined device (12) according to claim 15, wherein the internal heat exchanger (5) is located in the lower partition (28) between the confinement wall (32) and a high pressure inlet (13).

17. The combined device (12) according to claim 1, wherein the conduit (33) that connects the confinement wall (32) to the delimiting wall (31) extends through the accumulation area (20).

* * * * *